US009351568B2

(12) United States Patent
Goldberg

(10) Patent No.: US 9,351,568 B2
(45) Date of Patent: May 31, 2016

(54) STANDING DESK ACCESSORY

(71) Applicant: Michael Richard Goldberg, Oakland, CA (US)

(72) Inventor: Michael Richard Goldberg, Oakland, CA (US)

( * ) Notice: Subject to any disclaimer, the term of this patent is extended or adjusted under 35 U.S.C. 154(b) by 232 days.

(21) Appl. No.: 14/258,722

(22) Filed: Apr. 22, 2014

(65) Prior Publication Data

US 2015/0069797 A1 Mar. 12, 2015

Related U.S. Application Data

(60) Provisional application No. 61/964,241, filed on Dec. 30, 2013, provisional application No. 61/875,034, filed on Sep. 8, 2013.

(51) Int. Cl.

| | |
|---|---|
| ***A47B 83/02*** | (2006.01) |
| ***A47C 7/68*** | (2006.01) |
| ***A47C 7/70*** | (2006.01) |
| *A47B 3/14* | (2006.01) |

(52) U.S. Cl.

CPC . *A47B 83/02* (2013.01); *A47C 7/68* (2013.01); *A47C 7/70* (2013.01); *A47B 3/14* (2013.01); *A47B 2003/145* (2013.01)

(58) Field of Classification Search

CPC .... A47B 83/02; A47B 3/14; A47B 2003/145; A47B 83/00; A47C 7/68; A47C 7/70

USPC ..... 297/135, 173, 174 R

See application file for complete search history.

(56) References Cited

U.S. PATENT DOCUMENTS

| | | | | | |
|---|---|---|---|---|---|
| 659,431 | A * | 10/1900 | Anderson | A47B 27/00 | 108/152 |
| 749,670 | A * | 1/1904 | Gardner | A47B 57/045 | 108/9 |
| 828,079 | A * | 8/1906 | Williamson | A47B 3/14 | 182/220 |
| 2,214,204 | A * | 9/1940 | Pollard | A47B 83/02 | 108/47 |
| 2,869,146 | A * | 1/1959 | Allison | B60N 2/3095 | 224/561 |
| 2,973,028 | A | 2/1961 | Celeste | | |
| 3,050,355 | A * | 8/1962 | Hess | B60N 3/004 | 108/135 |
| 6,135,548 | A * | 10/2000 | McGuire | A47C 13/00 | 297/163 |
| 6,604,786 | B1 * | 8/2003 | Benden | A47C 7/70 | 297/153 |

* cited by examiner

*Primary Examiner* — Milton Nelson, Jr.
(74) *Attorney, Agent, or Firm* — Steven A. Nielsen

(57) ABSTRACT

A portable standing desk accessory that can attach to the top of any standard office chair or other type of chair. The desk assembly includes a flat desk member, a first and second support member and a retaining bracket. The first and second support members are hingedly attached to each other at one end respectively. The first support member is hingedly attached to the underside of the desk member and ends up residing on the front surface of the office chair back when in use. The second support member forms a triangular structure by attaching the free end to a retaining bracket mounted to the underside of the desk top. A flexible strap can further retain the first support member to the chair back. In the preferred embodiment, a phone holder pocket is inserted into a cutout area of the desk member.

8 Claims, 7 Drawing Sheets

STANDING DESK ACCESSORY

CROSS REFERENCE TO RELATED APPLICATIONS

This Utility Application claims the benefit of Provisional Patent Application No. 61/964,241, filed on Dec. 30, 2013. This Utility Application claims the benefit of Provisional Patent Application No. 61/875,034, filed on Sep. 8, 2013.

STATEMENT REGARDING FEDERALLY SPONSORED RESEARCH OR DEVELOPMENT

Not Applicable

DESCRIPTION OF ATTACHED APPENDIX

Not Applicable

BACKGROUND OF THE INVENTION (1) Field of the Invention

This invention relates generally to the field of furniture accessories and more specifically to a standing desk accessory that attaches to the back of an office chair.

Every day, millions of people around the world sit in office chairs at desks and perform various tasks such as computer work, crafts projects or other activities. The act of sitting for many hours a day can negatively affect a person's back posture and blood circulation. To counter this problem, some people elect to work at standing desks for varying periods of time; That is, a desk whose height is tall enough to allow a person to stand while performing normal activities at the desk. A number of manufacturers offer standing desks for sale, such as the "Uplift Desk" manufactured by The Human Solution Company of Austin, Tex. However these desks tend to be relatively expensive and therefore present a financial barrier to many individuals who would like to use a standing desk for some portion of the workday. To that end, it would be helpful to provide a desk attachment to an existing piece of office furniture, such as an office chair, that would give users the option of having the use of a standing desk at a much reduced price in comparison to current standing desk models, while limiting the amount of large or bulky furniture an individual must add to their current workspace.

(2) Description of the Related Art

Carmin Celeste, in her U.S. Pat. No. 2,973,028 disclosed a desk attachment for a folding chair where the attachment is fixed to the tubular frame of the chair and allows a flat surface to swing out behind the chair to form a desk surface.

Although the Celeste design, now in the public domain, shows the general concept of a desk surface attached to the top of a chair back, it has several deficiencies. Firstly, this design can not fit onto any standard chair, office chair or otherwise. It only fits on a specific type of tubular folding chair. Second, the desk surface of the Celeste design folds out of the rear of the chair, making the desk top potentially unstable when downward pressure is applied to it because the entire chair might tilt back on itself when excessive weight is placed on the desk top. Third, the Celeste design can not be easily and quickly removed or replaced from the chair as needed.

BRIEF SUMMARY OF THE INVENTION

The present invention overcomes shortfalls in the related art by presenting a desk accessory that is easily and securely attachable to any standard chair, office chair or other type of chair, allowing a user to stand while working at a much reduced price in comparison to other standing desks currently for sale. The known related art fails to disclose or present a standing desk that is not integrated into or require a specific type of chair, but rather can be added to any existing chair, as described in the disclosed manner.

An object of the invention is to provide a desk surface that can be attached to a standard office chair and be used in a standing position.

Another object of the invention is to provide a standing desk attachment that can be securely attached to and easily removed from any standard office chair.

Another object of the invention is to provide a standing desk attachment where the desk surface is in a stable position situated above the seating area of the chair.

Another object of the invention is to provide a standing desk accessory that folds flat for storage and transportation.

A further object of the invention is to provide a standing desk accessory whose angle of use can be adjusted.

Yet another object of the invention is to provide a standing desk accessory that includes a cell phone holder.

Another object of the invention is to provide a standing desk accessory that is relatively inexpensive to manufacture resulting in a relatively low retail selling price, in comparison to other standing desks.

Other objects and advantages of the present invention will become apparent from the following descriptions, taken in connection with the accompanying drawings, wherein, by way of illustration and example, an embodiment of the present invention is disclosed.

There is a disclosed embodiment of the standing desk accessory comprising: a flat desk member, a front retaining ledge, a hinge member, a hinge retaining plate, a first support member, a second support member, a retaining bracket for said second support member, said front retaining ledge being downwardly facing and fixedly attached to the front edge of said flat desk member, said retaining bracket fixedly attached to the underside of said flat desk member in a parallel relation to the rear edge of said desk member, said hinge member fixedly attached to the underside of said flat desk member in a parallel relation to said front retaining ledge, one end of said first support member attached to said hinge member and retained by said hinge retaining plate, the other end of said first support member hingedly attached to one end of said second support member, the opposite end of said second support member capable of being releasably attached to said retaining bracket, said front retaining ledge capable of capturing the top of a standard office chair back, said first support member capable of resting on the vertical front surface of said office chair back when said present invention is in use, said second support member forming an angled support brace between said first support member and said retaining bracket and causing said desk member to be firmly anchored on said office chair back in an approximately horizontal orientation in relation to the ground plane.

BRIEF DESCRIPTION OF THE DRAWINGS

The drawings constitute a part of this specification and include exemplary embodiments to the invention, which may be embodied in various forms. It is to be understood that in some instances various aspects of the invention may be shown exaggerated or enlarged to facilitate an understanding of the invention.

REFERENCE NUMERALS IN THE DRAWINGS

Figure 1:
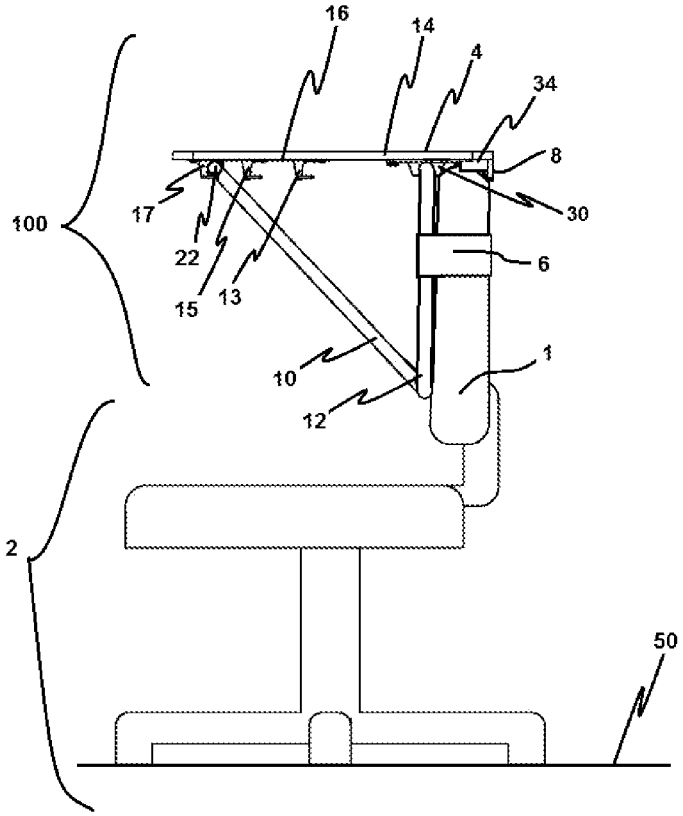
FIG. 1 is a side view of the standing desk accessory mounted on an office chair.

1. Chair back
2. Chair
4. Flat Desk Member
6. First Strap Member
7. Second Strap Member
8. Front Retaining ledge
8A. Front Retaining ledge of an alternative embodiment of the invention 100
10. Second support member
12. First support member
13. First C shaped retaining member
14. Hinge member
15. Second C shaped retaining member
16. Retaining bracket
17. Third C Shaped retaining member
18. Phone pocket
20. Mobile Phone
22. Tube end of second support member 10
24. Second tube end of second support member 10
26. Hook portion of hook and loop fastener
28. Portable computer
30. Hinge cover plate
32. Strap loop
34. Resilient Foam Pad
48. Desk top hinge
50. Ground plane
52. Phone holder pocket hole
100. Entire embodiment of the invention

DETAILED DESCRIPTION OF THE PREFERRED EMBODIMENTS

Detailed descriptions of the preferred embodiment are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

Referring now to FIG. 1 we see a side view of an embodiment 100 attached to the backrest 1 of a standard office chair 2. It should be noted that the invention can be attached to any chair, such as an office chair, dining chair or a folding chair. Alternatively, the disclosed embodiment 100 can be permanently attached to the chair 2 rather than the detachable version shown in the preferred embodiment. In the permanent version, shown in FIG. 7, the front ledge 8A would be fixedly attached to the chair back and hingedly 48 connected to the top of the chair back 1 so that the disclosed embodiment 100 could be flipped back to the rear side of the chair back when not in use.

In the preferred embodiment, a flat desk top member 4 is held in an approximate horizontal position in relation to the ground plane 50. The desk member 4 is situated above the chair's seat thereby making it stable even if the user puts excessive pressure on the desk top 4. However, it should be noted that the present invention 100 can be used in the reverse position, where the desk portion 4 is located behind chair back 1 when in the use position. Although this embodiment is possible with many chairs, the spine portion of some standard office chairs can make the attachment more difficult.

Additionally, the desk top 4 may be prone to tipping when excessive pressure is placed on it. The desk member 4 includes a front ledge 8 that captures the top portion of the chair back 1 between the ledge 8 and the hinge portion 14 of the first support member 12. A resilient foam pad 34 helps fill the space between the underside of the flat desk member 4 and the curved top portion of the top of the chair back 1. It also helps protect the top of chair back 1 from friction against the underside of desk member 4. A second support member 10 is angled from the first support member 12 to a C shaped retaining member 17 in retaining bracket 16 that retains the tube end 22 of the second support member 10. If the user attaches tube end 22 into C shaped retaining members 15 or 13 respectively, the desk member 4 will be fixed at a greater angle in relation to first support member 12, which may be preferable to some users. Strap 6 is attached to first support member 12 and adds another method of attachment of the invention 100 to the chair back 1, while increasing the stability of desk member 4.

Figure 2:
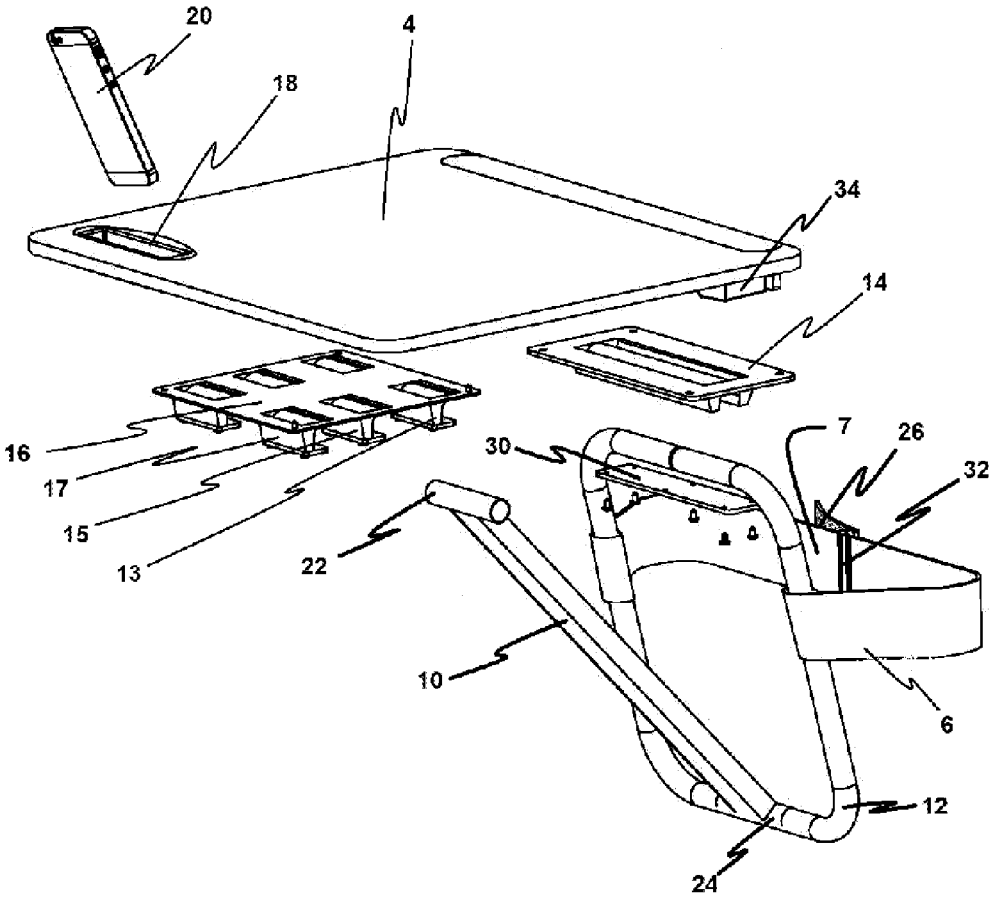
FIG. 2 is an exploded view of the support members of the standing desk accessory.

FIG. 2 is an exploded view of the support members 12, 10 and the holders for those members 14, 16 as well as desk member 4. The first support member 12 is made of a tube that is bent into a rectangular form. One end of the first support member 12 is attached to the underside of desk member 4 via hinge member 14 and captured by hinge plate 30. Hinge member 14 is fixedly attached to the underside of desk member 4. The second support member 10 has a tube welded to each end 24, 22 so that the resulting second support member 10 looks like the capital letter "I". End tube 24 is hingedly attached to one end of first support member 12. The other tube end 22 can be inserted into one of the C shaped retaining members 13, 15, 17 of retaining bracket 16. Retaining bracket 16 is fixedly attached to the underside of desk member 4. Straps 6, 7 are attached to each side of first support member 12.

In the preferred embodiment the end of strap 7 is inserted into strap loop 32 which is attached to strap end 6. Strap 7 is returned back on itself so that the Velcro brand hook portion 26 can be placed on the Velcro brand loop portion of strap 7 that covers the outside of the strap 7. Straps 6, 7 can then be used to further secure the invention 100 to the back of an office chair 2. In the preferred embodiment a pocket for cell phones 18 is inserted into the top of the desk member 4 so that a standard cell phone 20 or other electronic device can be inserted so that it is easily available to a user while working at the desk accessory 100.

Figure 3:
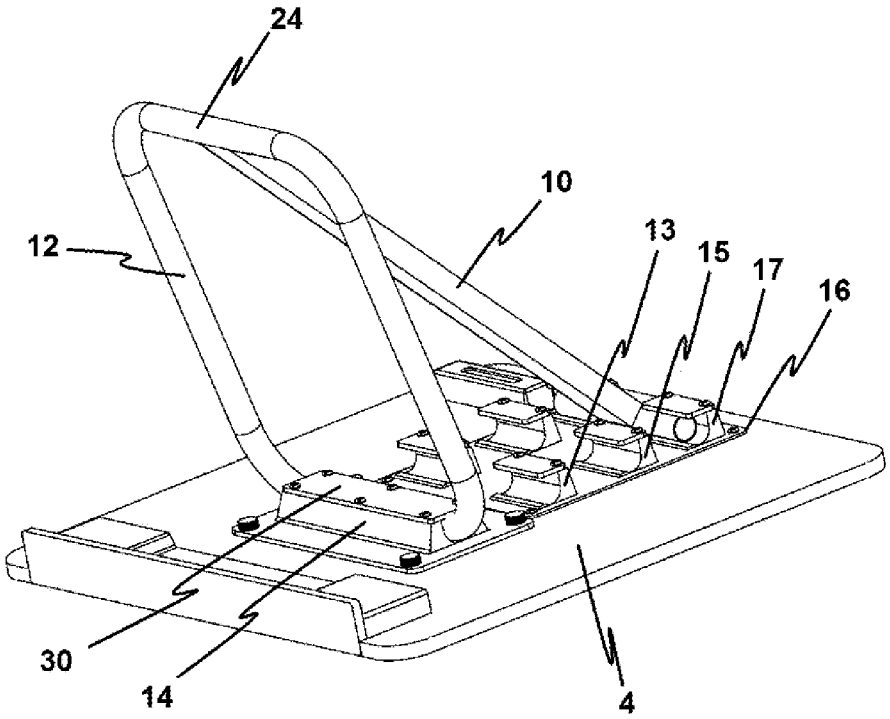
FIG. 3 is an underside view of the standing desk accessory.

FIG. 3 is a perspective view of the underside of the invention 100 with the straps 6, 7 removed for clarity. One end of first support member 12 is shown captured in hinge member 14, 30. Second support member 10 is attached to first support member 12 by end tube 24. The other end of support member 10 is removably attached into retaining member 16, 17.

Figure 4:
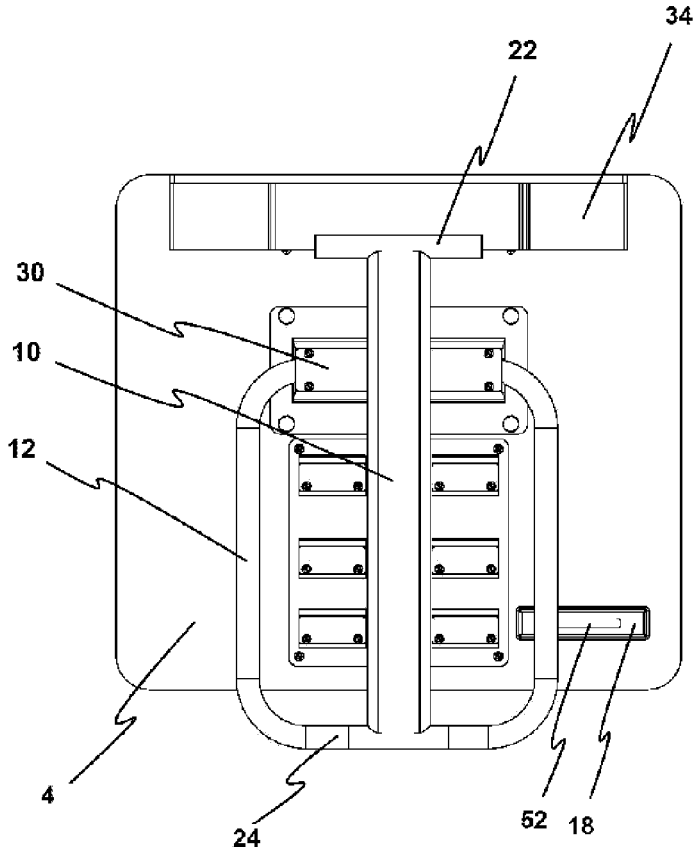
FIG. 4 is a plan view of the standing desk accessory in the folded position.

FIG. 4 is a plan view of the invention 100 in the flattened and stored position. The straps 6, 7 are removed for clarity purposes.

Figure 5:
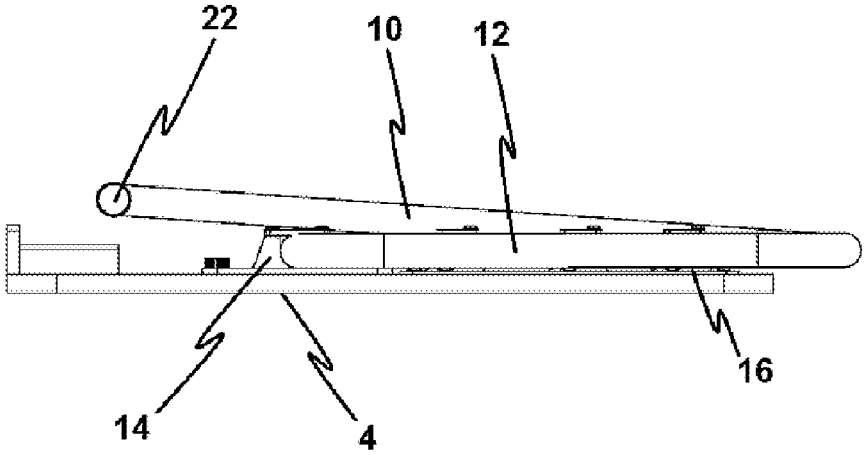
FIG. 5 is a side view of the standing desk accessory in the folded position.

FIG. 5 is a side view of the invention 100 in the flattened and stored position, allowing the invention 100 to be placed in a relatively flat box for shipping and storage.

Figure 6:
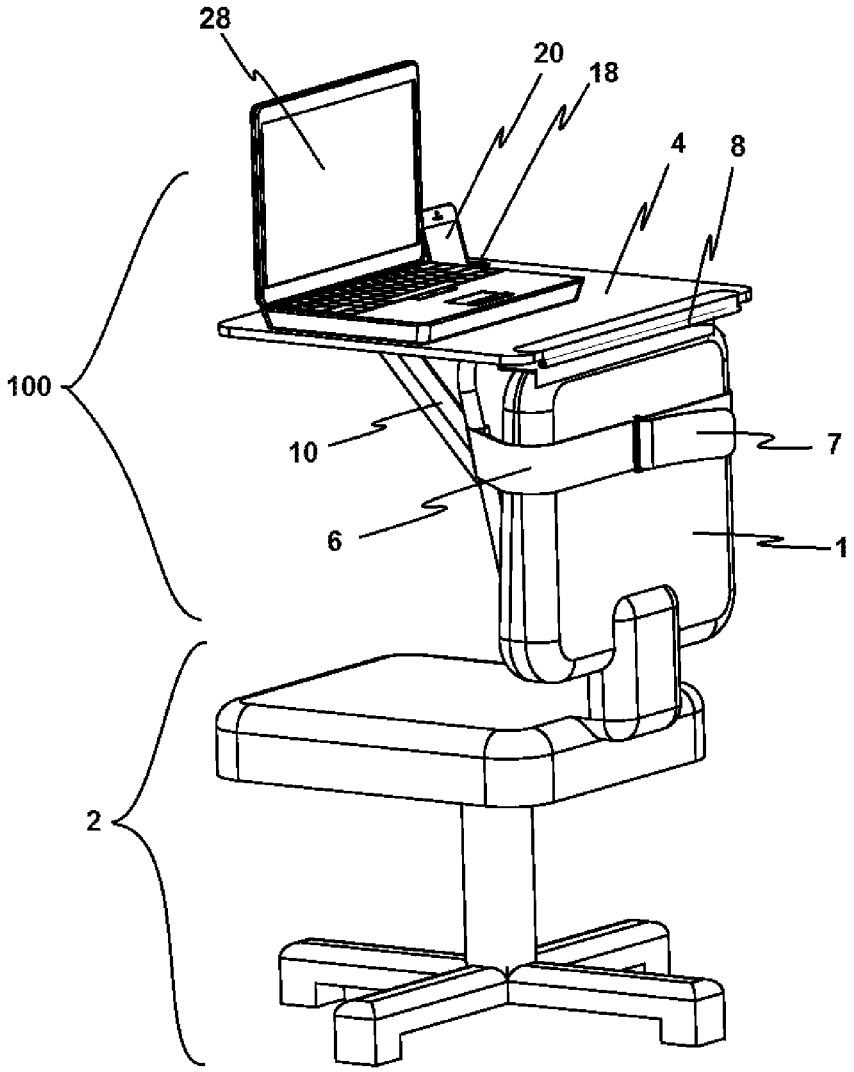
FIG. 6 is a perspective view of the standing desk accessory mounted to an office chair.

FIG. 6 is a perspective view of the invention 100 in the use position. A laptop computer 28 is resting on the desk member 4. A standard cell phone 20 is supported in phone pocket 18. A cutout area 52 on the bottom of pocket 18 as shown in FIG. 4 allows a charging cord for the phone 20 to be plugged into the phone while the phone is sitting in the pocket 18. The present invention 100 allows a person to work comfortably in a standing position without having to spend considerable dollars to purchase an entire separate desk dedicated to working in a standing position.

Figure 7:
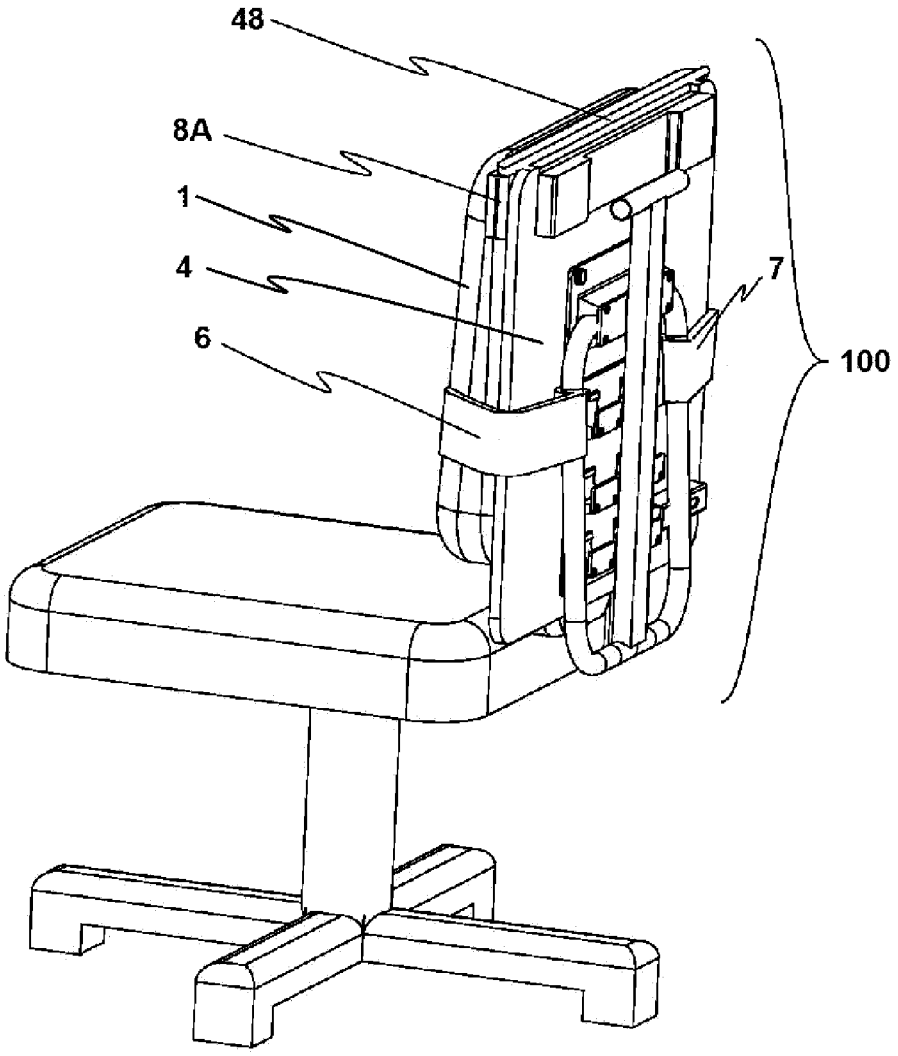
FIG. 7 is a perspective view of an alternate embodiment of the standing desk accessory that can be stored directly behind the chair backrest.

FIG. 7 is a perspective view of an alternate embodiment of the invention 100 where the ledge 8A is attached to the rear of the chair back 1 and is hingedly connected via hinge member 48 to the desk member 4. The ledge 8A can be either removably attached to chair back 1 by means of hook and loop fasteners, or other standard fasteners, or it can be permanently attached to the chair back 1 with adhesive, or incorporated into the chair back 1 as an actual integral portion of the chair back itself. The straps 6, 7 can further retain the invention 100 while not in use thereby allowing the user to have instant access to the invention 100 when so desired.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

What is claimed is:

1. A standing desk accessory comprising:

a flat desk member;

a front retaining ledge;

a hinge member;

a hinge retaining plate;

a first support member;

a second support member;

a retaining bracket for said second support member;

said front retaining ledge being downwardly facing and frictionally attached to the front edge of said flat desk member;

said retaining bracket for said second support member fixedly attached to the underside of said flat desk member;

said hinge member fixedly attached to the underside of said flat desk member in a parallel relation to said front retaining ledge;

one end of said first support member hingedly attached to said hinge member and retained by said hinge retaining plate;

the other end of said first support member hingedly attached to one end of said second support member;

the opposite end of said second support member capable of being releasably attached to said retaining bracket for said second support member;

said front retaining ledge capable of resting on a top of and behind a back of a chair;

said first support member capable of resting on the vertical front surface of said back of said chair;

said second support member forming a triangular hypotenuse between said first support member and said retaining bracket for said second support member; and, causing said flat desk member to be firmly anchored in an approximately horizontal orientation to the top of said back of said chair.

2. A standing desk accessory as claimed in claim 1 further comprising a resilient foam strip fixedly attached to the underside of said flat desk member and acting as a cushion between the underside of said flat desk member and the top of said back of said chair.

3. A standing desk accessory as claimed in claim 1 further comprising a cell phone holding pocket fixedly attached to a cutout area of said flat desk member.

4. A standing desk accessory as claimed in claim 1 further comprising a first and second strap member; one side of said first strap member attached at one end to the left side of said first support member;

one side of said second strap member attached at one end to the right side of said first support member;

said first and second strap members wrapping around the back of said chair and attaching themselves to each other by attachment means, to further secure said standing desk accessory to said back of said chair.

5. A standing desk accessory as claimed in claim 1 wherein said first support member is comprised of a rectangularity shaped tubular assembly.

6. A standing desk accessory as claimed in claim 1 wherein said second support member is comprised of a rigid longitudinal post;

said longitudinal post having perpendicularly placed posts fixedly and centrally attached to each end of said longitudinal post in a configuration resembling a capital "I".

7. A standing desk accessory as claimed in claim 1 wherein said front retaining ledge is fixedly attached to a chair back in a permanent fashion as an integral part of a chair.

8. A standing desk accessory as claimed in claim 1 wherein said front retaining ledge is attachable to said back of said chair and is hingedly attached to said flat desk member allowing said flat desk member to be folded back and capable of being stored directly behind said back of said chair.

* * * * *